US011565906B2

(12) United States Patent
Ariga

(10) Patent No.: US 11,565,906 B2
(45) Date of Patent: Jan. 31, 2023

(54) SHEET CONVEYING APPARATUS

(71) Applicant: Motoi Ariga, Yamanashi-ken (JP)

(72) Inventor: Motoi Ariga, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/505,861

(22) Filed: Oct. 20, 2021

(65) Prior Publication Data

US 2022/0135362 A1 May 5, 2022

(30) Foreign Application Priority Data

Oct. 29, 2020 (JP) ..... JP2020-181448
Sep. 29, 2021 (JP) ..... JP2021-158617

(51) Int. Cl.
*B65H 29/62* (2006.01)
*B65H 43/04* (2006.01)

(52) U.S. Cl.
CPC ..... *B65H 43/04* (2013.01); *B65H 29/62* (2013.01); *B65H 2301/448* (2013.01); *B65H 2511/524* (2013.01); *B65H 2801/06* (2013.01)

(58) Field of Classification Search
None
See application file for complete search history.

(56) References Cited

U.S. PATENT DOCUMENTS 6,908,078 B2 * 6/2005 Suzuki ..... B65H 31/3027 270/17
7,651,092 B2 * 1/2010 Hirao ..... G03G 15/6552 271/262
8,328,192 B2 * 12/2012 Yamazaki ..... B65H 7/02 271/262
8,360,424 B2 * 1/2013 Tomii ..... B65H 7/02 271/265.04
8,752,830 B2 * 6/2014 Fukusaka ..... B65H 3/46 271/262
9,150,371 B2 * 10/2015 Mutsuno ..... G06F 3/1259
9,535,387 B2 * 1/2017 Nonaka ..... G03G 15/5012
10,233,047 B2 * 3/2019 Maeda ..... B65H 29/60
10,277,753 B2 * 4/2019 Tachibana ..... H04N 1/00602
11,365,076 B2 * 6/2022 Kondo ..... B65H 5/025
(Continued)

FOREIGN PATENT DOCUMENTS

JP 2007-279168 A 10/2007
JP 2016-210536 A 12/2016

*Primary Examiner* — Leslie A Nicholson, III
(74) *Attorney, Agent, or Firm* — Manabu Kanesaka

(57) ABSTRACT

The present invention is to provide a sheet conveying apparatus capable of reliably detecting a full-load state of a storage section for storing sheets discharged from a sheet conveyance path when an abnormality such as multi feed is detected, a sheet feed apparatus is provided with a multi feed sheet storage section disposed below a common conveyance path to store multi-fed sheets with multi feed detected, and a flap member rotating between a first rotation position for supporting a sheet in the common conveyance path to be able to convey to the downstream side in a conveyance direction, and a second rotation position for guiding to the multi feed sheet storage section, and determines that the multi feed sheet storage section is in a full-load state in detecting that the flap member does not return to the first rotation position.

5 Claims, 10 Drawing Sheets

(56) References Cited

U.S. PATENT DOCUMENTS

| | | | | |
|---|---|---|---|---|
| 2009/0001646 | A1* | 1/2009 | Matsumoto | G03G 15/6511 270/18 |
| 2021/0294258 | A1* | 9/2021 | Suzuki | B65H 5/062 |

* cited by examiner

SHEET CONVEYING APPARATUS

TECHNICAL FIELD

The present invention relates to a sheet conveying apparatus for conveying sheets, and an image forming system provided with the sheet conveying apparatus.

BACKGROUND ART

Generally, there is a known image forming system provided with an image forming apparatus such as a copier and printer, and a sheet feed apparatus arranged parallel with the image forming apparatus. The sheet feed apparatus includes paper feed cassettes for storing a plurality of sheets to be able to supply sheets to the image forming apparatus, as a sheet conveying apparatus.

In Patent Document 1 is proposed an image forming apparatus provided with an escape tray in an upper portion of a sheet feed unit. A sheet with an abnormality such as multi feed and skew detected by an abnormality detecting sensor is conveyed to an escape conveyance path side branched off from a common conveyance path, and is discharged to the escape tray.

In Patent Document 2 is described an image forming system provided with a paper feed apparatus with a purge box provided below a sheet conveyance path for conveying sheets to an image forming apparatus. In the case where an abnormality such as a jam is detected during sheet conveyance, since a sheet remaining on the sheet conveyance path is discharged to the purge box by controlling a purge guide, the user is capable of omitting operation for removing from the paper feed apparatus.

PRIOR ART DOCUMENT

Patent Document

[Patent Document 1] Japanese Unexamined Patent Publication No. 2007-279168

[Patent Document 2] Japanese Unexamined Patent Publication No. 2016-210536

DISCLOSURE OF INVENTION

Problems to be Solved by the Invention

However, in the above-mentioned conventional apparatus, the sheet discharged to the escape tray or purge box is unstable and is easy to stack disorderly. Actually, before reaching the beforehand set maximum stack number of sheets, there is the risk that it is not possible to discharge more sheets, and that a full-load state of sheets is not detected even by installing a sensor.

Therefore, the present invention was made to resolve the above-mentioned conventional problem, and it is an object of the invention to provide a sheet conveying apparatus which is provided with a storage section for storing sheets discharged from a sheet conveyance path when an abnormality such as multi feed, skew and jam is detected during sheet conveyance, and which is capable of reliably detecting a full-load state incapable of storing more sheets in the storage section.

Further, it is an object of the invention to provide an image forming system provided with the sheet conveying apparatus and an image forming apparatus.

Means for Solving the Problem

A sheet conveying apparatus of the present invention is provided, in some aspect, with a conveying section for conveying a sheet in a predetermined conveyance direction, a conveyance path for guiding the sheet conveyed by the conveying section, a multi feed detecting section for detecting multi feed of sheets conveyed in the conveyance path, a storage section disposed below the conveyance path to store multi-fed sheets with the multi feed detected by the multi feed detecting section, a position changing member disposed between the conveyance path and the storage section to be able to change a position to a first position for guiding the sheet conveyed in the conveyance path to the downstream side in the conveyance direction in the position for closing an entry of the sheet from the conveyance path to the storage section, and to a second position for guiding the multi-fed sheets from the conveyance path to the storage section in the position for allowing the entry of the sheets from the conveyance path to the storage section, a control section for controlling operation of the position changing member for changing the position between the first position and the second position, a detecting section for detecting whether the position changing member is positioned in the first position or the second position, and a determining section for determining that the storage section is full-load, in the case where the detecting section detects that the position changing member does not return to the first position, after the multi feed detecting section detects the multi feed of sheets, the control section changes the position of the position changing member to the second position from the first position, the multi-fed sheets are conveyed from the conveyance path to the storage section, and after a lapse of a predetermined time, the control section changes the position changing member toward the first position.

A sheet conveying apparatus of the present invention is provided, in another aspect, with a conveying section for conveying a sheet in a predetermined conveyance direction, a conveyance path for guiding the sheet conveyed by the conveying section, a multi feed detecting section for detecting multi feed of sheets conveyed in the conveyance path, a storage section disposed below the conveyance path to store multi-fed sheets with the multi feed detected by the multi feed detecting section and a subsequent sheet conveyed in the conveyance path subsequently to the multi-fed sheets, a position changing member disposed between the conveyance path and the storage section to be able to change a position to a first position for guiding the sheet conveyed in the conveyance path to the downstream side in the conveyance direction in the position for closing an entry of the sheet from the conveyance path to the storage section, and to a second position for guiding the multi-fed sheets and the subsequent sheet from the conveyance path to the storage section in the position for allowing the entry of the sheets from the conveyance path to the storage section, a control section for controlling operation of the position changing member for changing the position between the first position and the second position, a detecting section for detecting whether the position changing member is positioned in the first position or the second position, and a determining section for determining that the storage section is full-load, in the case where the detecting section detects that the position changing member does not return to the first position, after the multi feed detecting section detects the multi feed of sheets, the control section changes the position of the position changing member to the second position from the first position, the multi-fed sheets and the subsequent sheet subsequently to the sheets are conveyed to the storage section, and after a lapse of a predetermined time, the control section changes the position changing member toward the first position.

Advantageous Effect of the Invention

According to the present invention, corresponding to the position of the position changing member, in the case of detecting that the position changing member changed to the second position does not return to the first position, it is possible to reliably determine that the storage section is in a full-load state.

MODE FOR CARRYING OUT THE INVENTION

A suitable Embodiment of the present invention will be described below with reference to accompanying drawings in detail. First, an image forming system of this Embodiment will be described with reference to FIGS. 1 and 2.

[Image Forming System]

Figure 1:
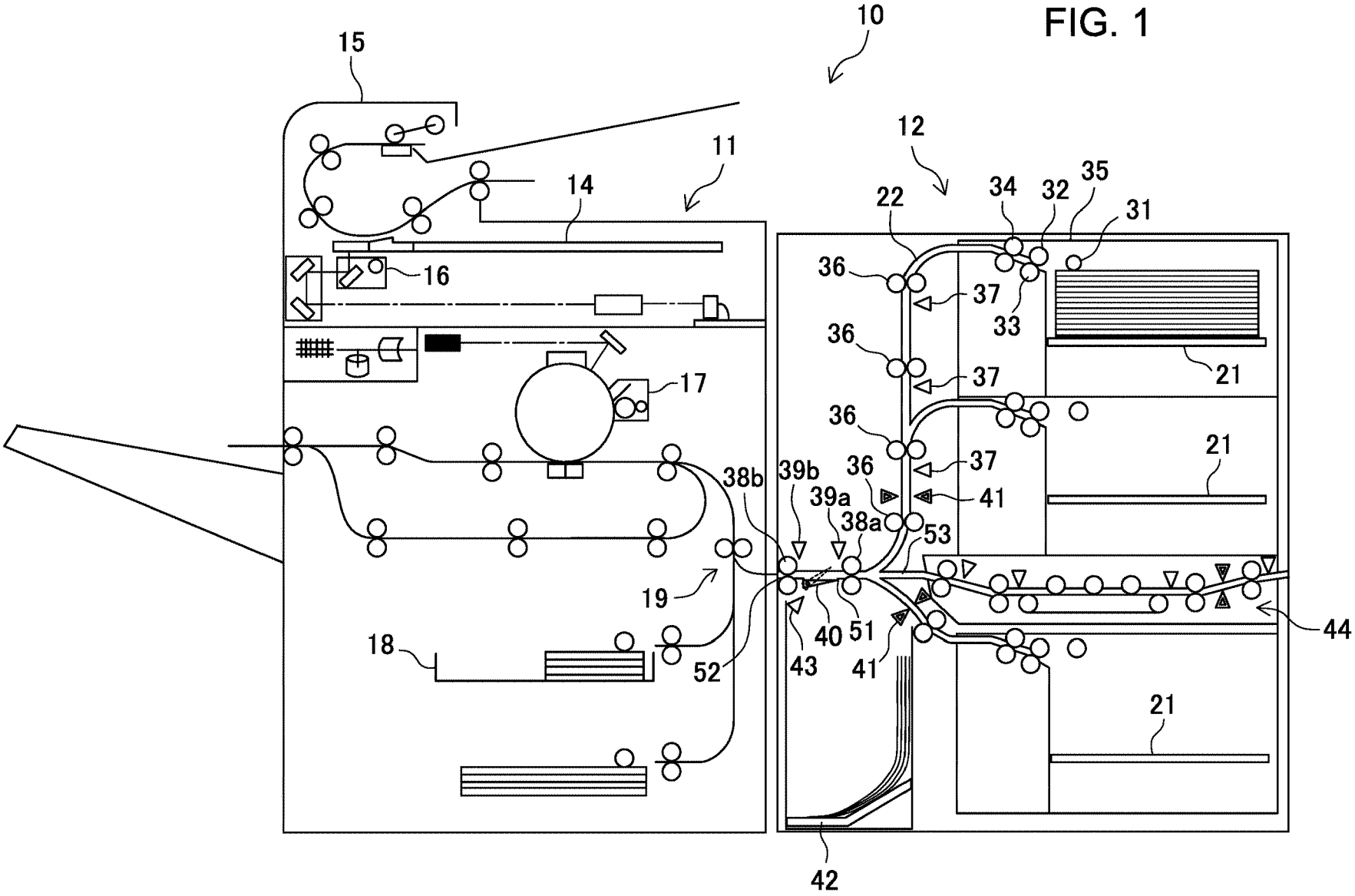
FIG. 1 is a schematic configuration cross-sectional view of an image forming system comprised of an image forming apparatus and sheet feed apparatus according to an Embodiment of the present invention.

FIG. 1 is a cross-sectional view schematically illustrating an Embodiment of an image forming system provided with a sheet feed apparatus and image forming apparatus according to this Embodiment. In the following description, as the image forming apparatus including an image forming section, a laser printer system (hereinafter, simply called a printer) using an electrophotographic scheme will be described as an example. In addition, as well as the printer, the image forming apparatus constituting the image forming system may be a copier, facsimile, composite machine and the like. Further, the image forming apparatus is not limited to the electrophotographic scheme, and may be a configuration of another scheme such as an ink jet scheme.

Figure 2:
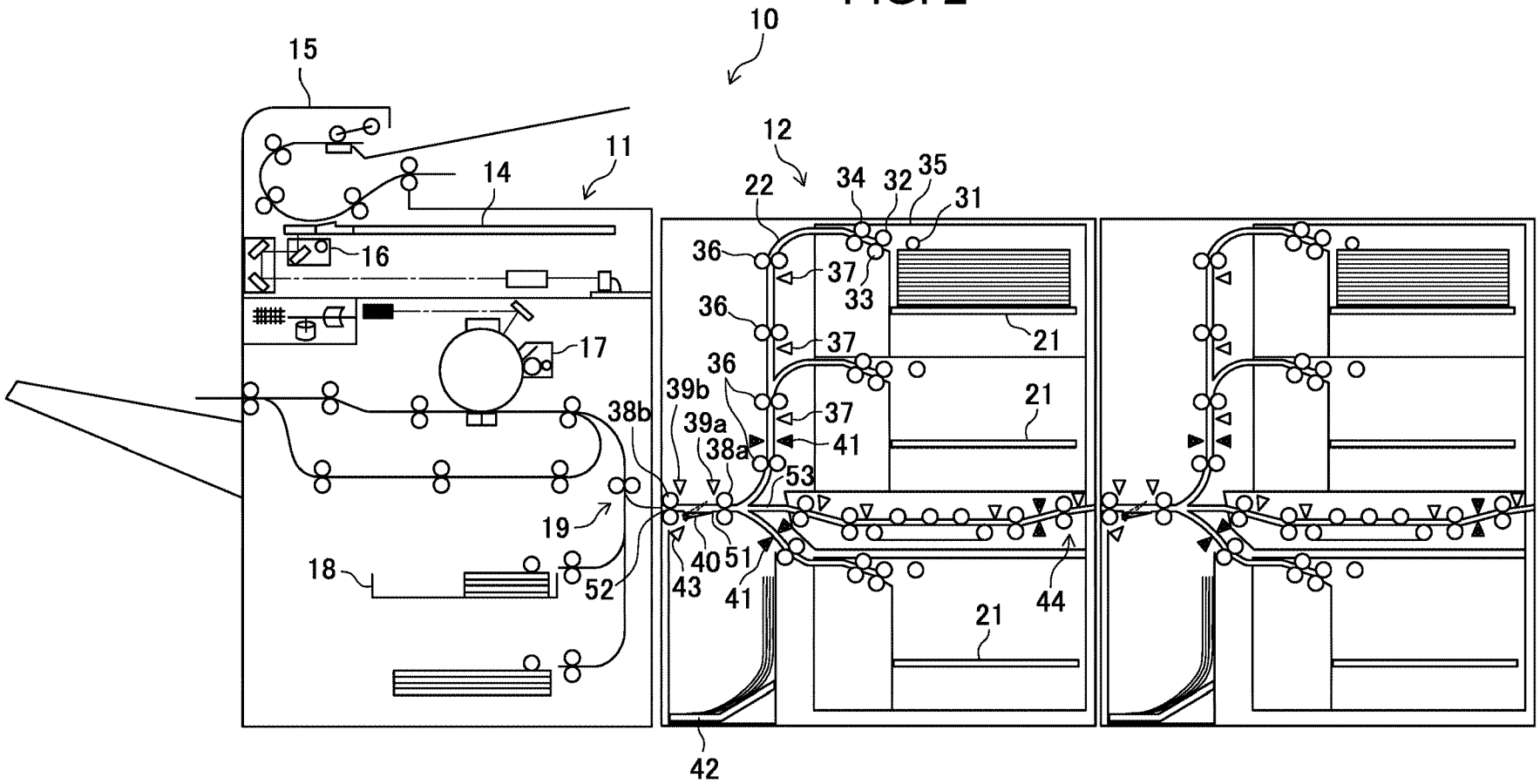
FIG. 2 is a schematic configuration cross-sectional view of an image forming system where the image forming apparatus is provided with parallel arranged sheet feed apparatuses.

The image forming system 10 of this Embodiment includes an image forming apparatus 11, and a sheet feed apparatus 12 connected to the image forming apparatus 11. As shown in FIG. 2, it is possible to parallel connect a plurality of sheet feed apparatuses 12 to the image forming apparatus 11.

The image forming apparatus 11 forms a toner image (image) on a sheet corresponding to an image signal from a document reading apparatus 15 connected to an image forming apparatus main body, or a host apparatus such as a personal computer connected to the image forming apparatus main body to be communicable and the like. In the case of this Embodiment, the document reading apparatus 15 is integrally disposed on the image forming apparatus main body.

In reading a document, the document reading apparatus 15 irradiates the document placed on platen glass 14 with light by a scanning optical system light source, while inputting reflected light to a CCD, and thereby reads a document image. Further, the document reading apparatus 15 is provided with an automatic document feeder (ADF) installed above the apparatus 15, and is also able to read a document image by automatically conveying a document placed on a document tray to a reading section 16 of the document reading apparatus 15 by the ADF. The read document image is converted into an electric signal, and is transmitted to a laser scanner of an image forming section 17 described later. There is also the case where image data transmitted from the personal computer or the like is input to the laser scanner as described above.

The image forming apparatus 11 is provided with the image forming section 17, paper feed section 18, sheet conveying section 19 and the like inside the image forming apparatus main body. In the image forming apparatus 11, a control section described later controls each section. The control section has a CPU (Central Processing Unit), ROM (Read Only Memory), RAM (Random Access Memory) and the like. The CPU reads programs that correspond to control procedures stored in the ROM to control each section. In the RAM is stored operation data and input data, and the CPU performs control by referring to the data stored in the RAM, based on the programs and the like.

The paper feed section 18 is provided with publicly known structure comprised of a plurality of cassettes each to store sheets, a pick-up roller, and a separation conveyance roller pair comprised of a feed roller and retard roller. The sheets stored inside the cassette are separated and fed on a sheet-by-sheet basis, by the pick-up roller for performing up-and-down operation and rotating at predetermined timing, and the separation conveyance roller pair.

The sheet conveying section 19 is provided with publicly known structure comprised of a conveyance roller pair and register roller pair. The sheet fed from the paper feed section 18 is passed through a sheet conveyance path by the conveyance roller pair, and then, is guided to the register roller pair. Subsequently, the sheet is fed to the image forming section 17 at predetermined timing by the register roller pair.

The sheet supplied from the sheet feed apparatus 12 is conveyed into the image forming apparatus 11 via a connection path opened in a side face on the side coupled to the image forming apparatus 11. The sheet conveyed into the image forming apparatus 11 from the sheet feed apparatus 12 is fed into the image forming section 17 at predetermined timing via the register roller pair, as the sheet conveyed from the paper feed section 18 inside the image forming apparatus 11.

The image forming section 17 is provided with publicly known structure comprised of a photosensitive drum, a charger, the laser scanner, a developing device, transfer apparatus, a cleaner and the like. At the time of image formation, the photosensitive drum is driven to rotate in a predetermined direction, and a surface of the photosensitive drum is uniformly charged by the charger. The charged photosensitive drum is irradiated with laser light from the laser scanner emitted corresponding to the image signal, and an electrostatic latent image is thereby formed on the photosensitive drum. The electrostatic latent image thus formed on the photosensitive drum is subsequently developed as a toner image by the developing device.

Subsequently, the toner image on the photosensitive drum is transferred to the sheet by the transfer apparatus. The sheet with the toner image thus transferred is conveyed to a fuser apparatus to fuse the toner image, and is discharged to a discharge tray outside the apparatus provided in the side face of the image forming apparatus main body on the side opposite to the sheet feed apparatus 12, by a discharge roller.

In the case of forming a toner image on the backside of the sheet, the sheet discharged from the fuser apparatus is conveyed to a reverse conveyance path. Then, in a state in which the side is reversed by the reverse conveyance path, the sheet is conveyed again to the image forming section. The sheet with the toner image transferred to the backside is conveyed to the fuser apparatus, and after fusing the toner image, is discharged to the discharge tray by the discharge roller. After transferring, transfer residual toner left on the photosensitive drum is removed by the cleaner.

[Sheet Feed Apparatus]

The sheet feed apparatus 12 is provided with multi-stage deck structure having a plurality of storage chambers each capable of storing a plurality of sheets, and is capable of feeding sheets to the image forming apparatus 11 from each of the storage chambers. As shown in FIG. 2, a sheet fed from the sheet feed apparatus connected to the upstream side with respect to a sheet conveyance direction to the image forming apparatus 11 is conveyed to the image forming apparatus 11 via a relay conveying apparatus 44 provided in the sheet feed apparatus 12 on the downstream side. As sheets supplied to the image forming apparatus 11, there are papers such as normal paper, thin paper and thick paper, plastic sheets and the like. Further, as well as the entirely uniform flat sheet, the sheet includes a fold sheet having a fold portion such as an envelope having a flap portion.

A configuration of the sheet feed apparatus 12 will be described more specifically. The sheet feed apparatus 12 is provided with a plurality of storage chambers 21, relay conveying apparatus 44 and the like. Each of the storage chambers 21 is capable of stacking a large amount of sheets, and is configured to be able to move up and down in a state of thus stacking a large amount of sheets. In this Embodiment, three storage chambers 21 are arranged in three stages vertically, and the relay conveying apparatus 44 is disposed between the lowermost storage chamber 21 and the second uppermost storage chamber 21.

A configuration for feeding out the sheet from the storage chamber 21 will be described, using the uppermost storage chamber 21 in FIG. 1 as an example. The storage chamber 21 is provided with a pick-up roller 31 for coming into contact with the uppermost sheet among stacked sheets, and a separation feed section 35 on the upstream side of a conveyance path 22 of the sheet fed out of the storage chamber 21. The pick-up roller 31 is configured to separate from the top surface of the uppermost sheet of the storage chamber 21 at any or required timing, or come into contact with the top surface of the uppermost sheet. The separation feed section 35 has a feed roller 32 and separation roller 33 disposed vertically with the conveyance path 22 therebetween. The conveyance path 22 is provided with a draw roller pair 34 on the downstream side of the separation feed section 35.

Concurrently with startup of the feed apparatus 12, each storage chamber 21 moves up to a pick-up position for enabling the uppermost sheet stacked on the storage chamber 21 to be picked up by the pick-up roller 31. The sheet fed out of the storage chamber 21 by the pick-up roller 31 is nipped, separated on a sheet-by-sheet basis by the feed roller 32 and separation roller 33, and is fed to the conveyance path 22 by the draw roller pair 34. Whenever the pick-up roller 31 picks up the predetermined number of sheets, the storage chamber 21 is controlled so that the uppermost sheet is moved up to the pick-up position.

A common conveyance path 51 is connected to a downstream end of the conveyance path 22, and the above-mentioned connection path 52 is connected to a downstream end of the path 51. The second uppermost storage chamber 21 and lowermost storage chamber 21 are also provided with conveyance paths similar to the conveyance path 22 of the uppermost storage chamber 21 so as to convey picked-up sheets respectively, and the paths are merged with the connection path 52. The conveyance path 22 from the uppermost storage chamber 21 and the conveyance paths from the other storage chambers 21 are provided with a plurality of conveyance roller pairs 36 so as to feed the sheet to the common conveyance path 51. The common conveyance path 51 is provided with horizontal conveyance rollers 38*a*, 38*b* to feed the sheet to the image forming apparatus 11 via the connection path 52. Further, the conveyance path 22, the other conveyance paths and common conveyance path 51 are provided with sheet sensors 37 and horizontal conveyance sensors 39*a*, 39*b* so as to detect a position of the sheet conveyed in the paths.

The sheet conveyed from the uppermost storage chamber 21 to the conveyance path 22 passes through the common conveyance path 51 connected to the downstream end of the conveyance path 22, and is conveyed to the image forming apparatus 11 via the connection path 52. Similarly, the sheet fed out of the second uppermost storage chamber 21 and the sheet fed out of the lowermost storage chamber 21 are also conveyed to the respective corresponding conveyance paths, and are conveyed to the image forming apparatus 11 via the connection path 52 from the common conveyance path 51 connected to downstream ends of the paths.

The relay conveying apparatus 44 is provided with a plurality of roller pairs to convey the sheet in the sheet conveyance direction. A downstream end of the relay conveying apparatus 44 is connected to a conveyance path 53, and a downstream end of the path 53 is connected to the common conveyance path 51. A sheet of the sheet feed apparatus 12 parallel arranged on the upstream side passes through the relay conveying apparatus 44 of the sheet feed apparatus 12 on the downstream side, is fed to the conveyance path 53, and is conveyed to the image forming apparatus 11 via the common conveyance path 51 and connection path 52. Further, the relay conveying apparatus 44 is provided with a correction mechanism to prevent and correct skew and misregistration in a sheet width direction of the conveyed sheet.

Figure 3:
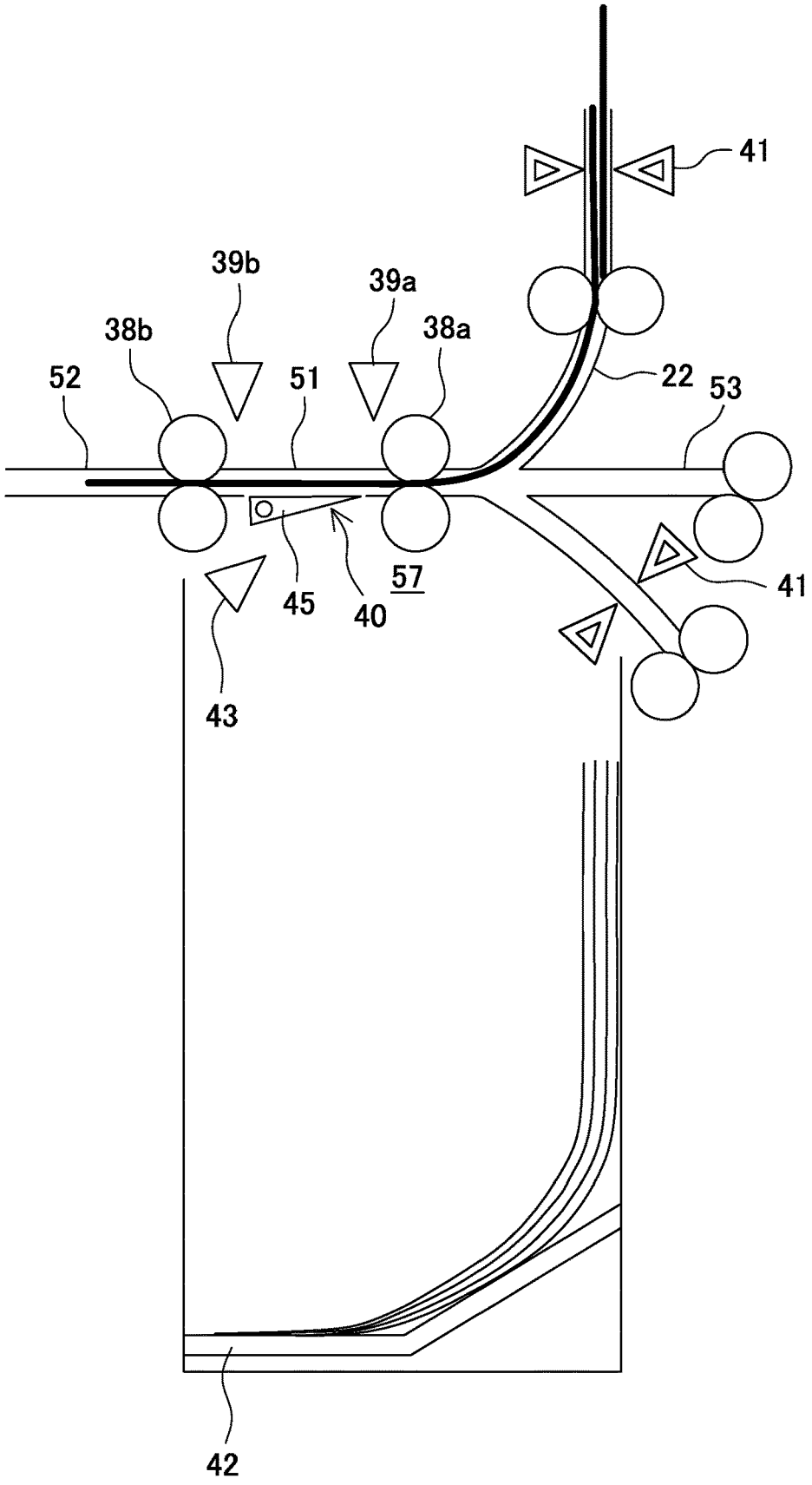
FIG. 3 is an explanatory view of a state where a path switch member of the sheet feed apparatus is not able to move.
Figure 4:
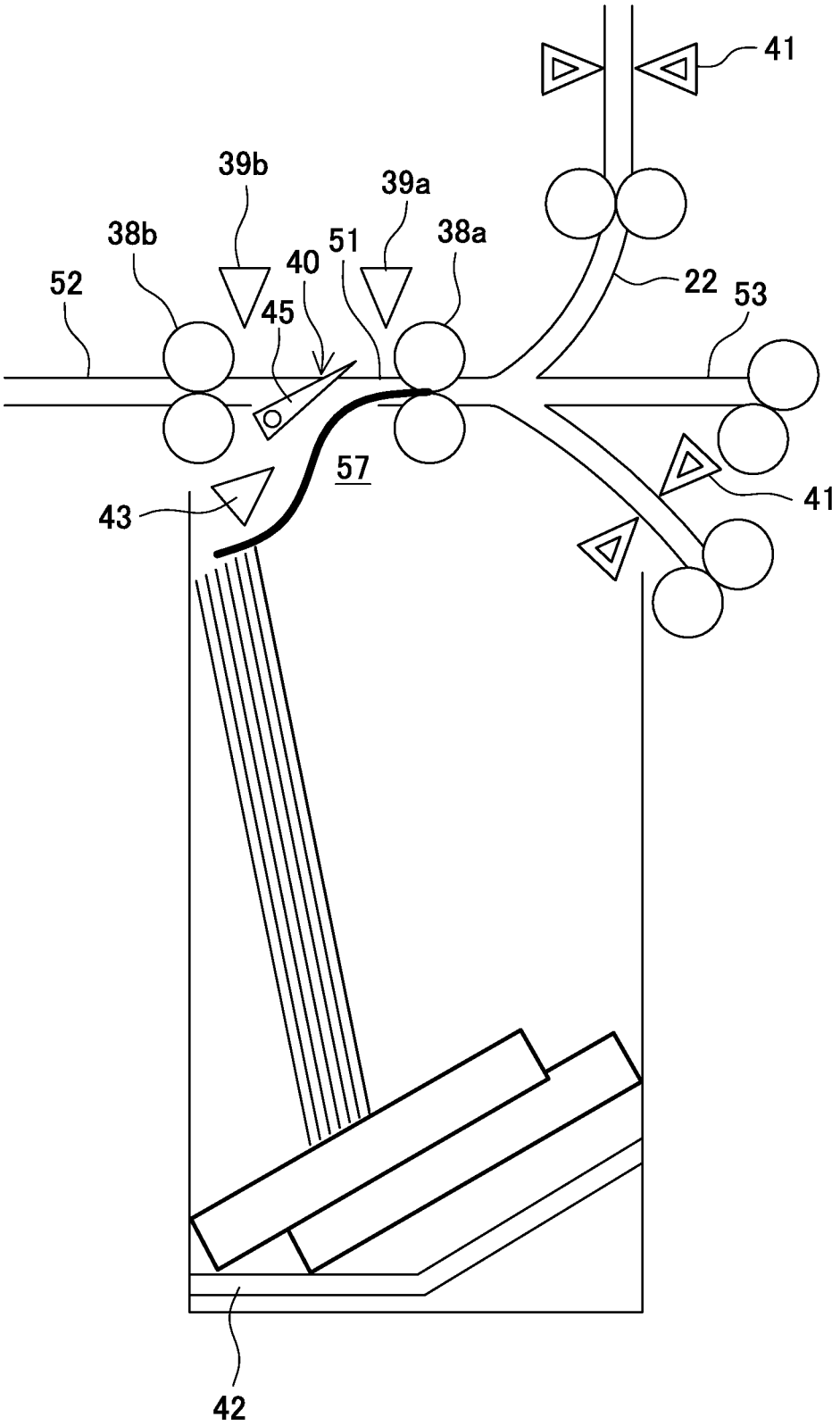
FIG. 4 is an explanatory view of another state where the path switch member of the sheet feed apparatus is not able to move.

Sheets in the storage chamber 21 are separated on a sheet-by-sheet basis to feed as described above, and are conveyed to the image forming apparatus 11 via the conveyance path 22, common conveyance path 51 and connection path 52, and in the process of conveying, multi feed sometimes occurs where a prior sheet and another sheet subsequent thereto overlap in parts and are conveyed. In order to detect such multi feed of sheets, the sheet feed apparatus 12 is provided with multi feed detecting sensors. In this Embodiment, as shown in FIGS. 3 and 4, a multi feed detecting sensor 41 is disposed at some midpoint of each conveyance path 22. For example, the multi feed detecting sensor 41 is a sensor for detecting that two or more sheets overlap and are conveyed by ultrasonic waves.

Further, in order to remove sheets with multi feed detected i.e. multi-fed sheets from the path to store, the sheet feed apparatus 12 is provided with a multi feed sheet storage section 42. In this Embodiment, the multi feed sheet storage section 42 is disposed below the common conveyance path 51. The multi feed sheet storage section 42 is defined as internal space with sufficient height and plane dimensions to receive the high number of multi-fed sheets. On a bottom of the multi feed sheet storage section 42 is disposed an escape tray to stack multi-fed sheets.

As shown in FIG. 4, in the common conveyance path 51, in a lower guide 55 thereof is formed an opening portion 57 communicating from the common conveyance path 51 to the multi feed sheet storage section 42. The opening portion 57 has a predetermined length dimension in the sheet conveyance direction, and in a sheet width direction orthogonal to the sheet conveyance direction, a width dimension exceeding a width dimension of the sheet conveyed in the common conveyance path 51. In order to open and close the opening portion 57 selectively, a switch portion 40 is provided in the common conveyance path 51.

Figure 5:
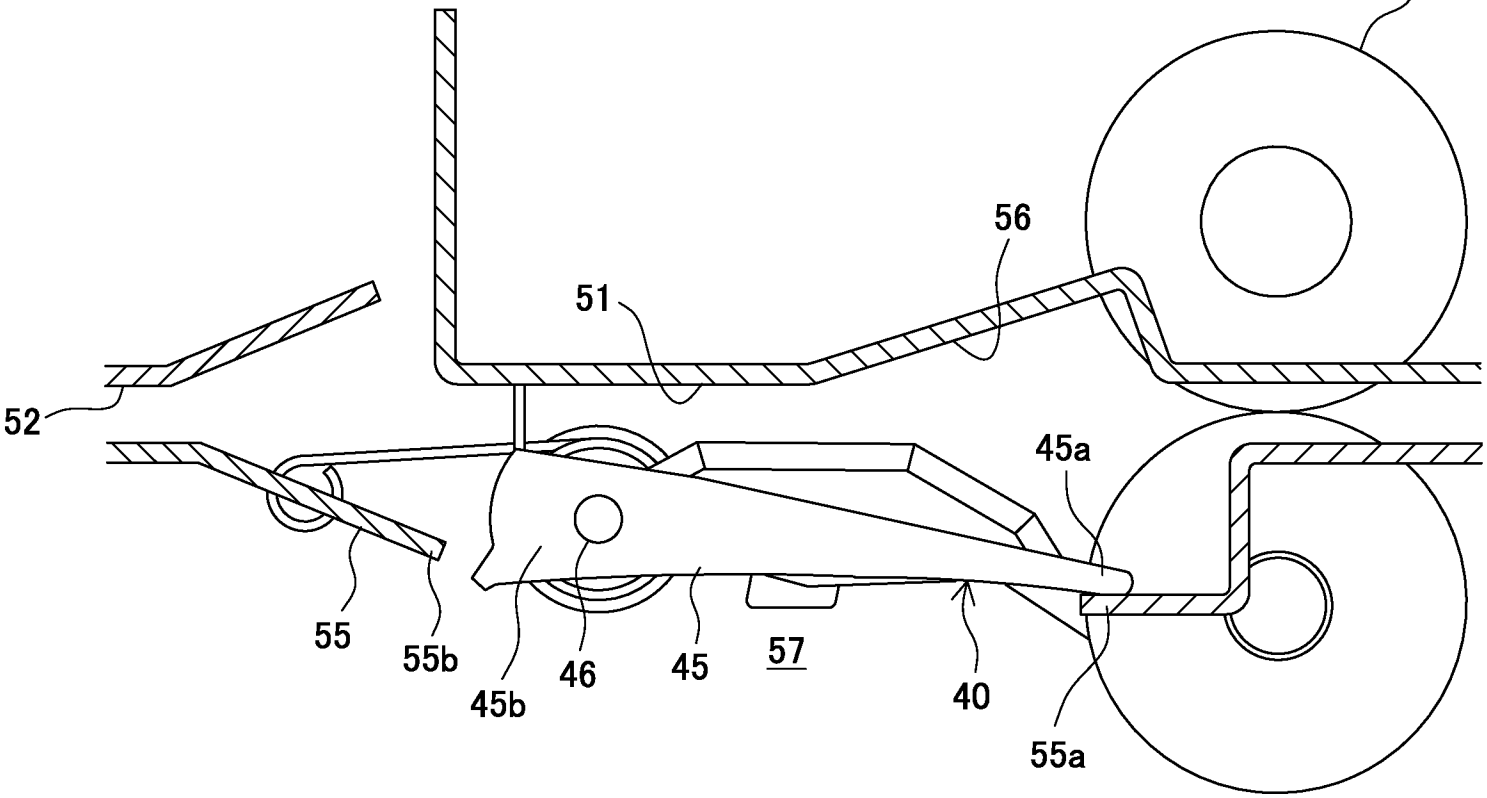
FIG. 5 is a partial enlarged view illustrating operation of a flap member.
Figure 6:
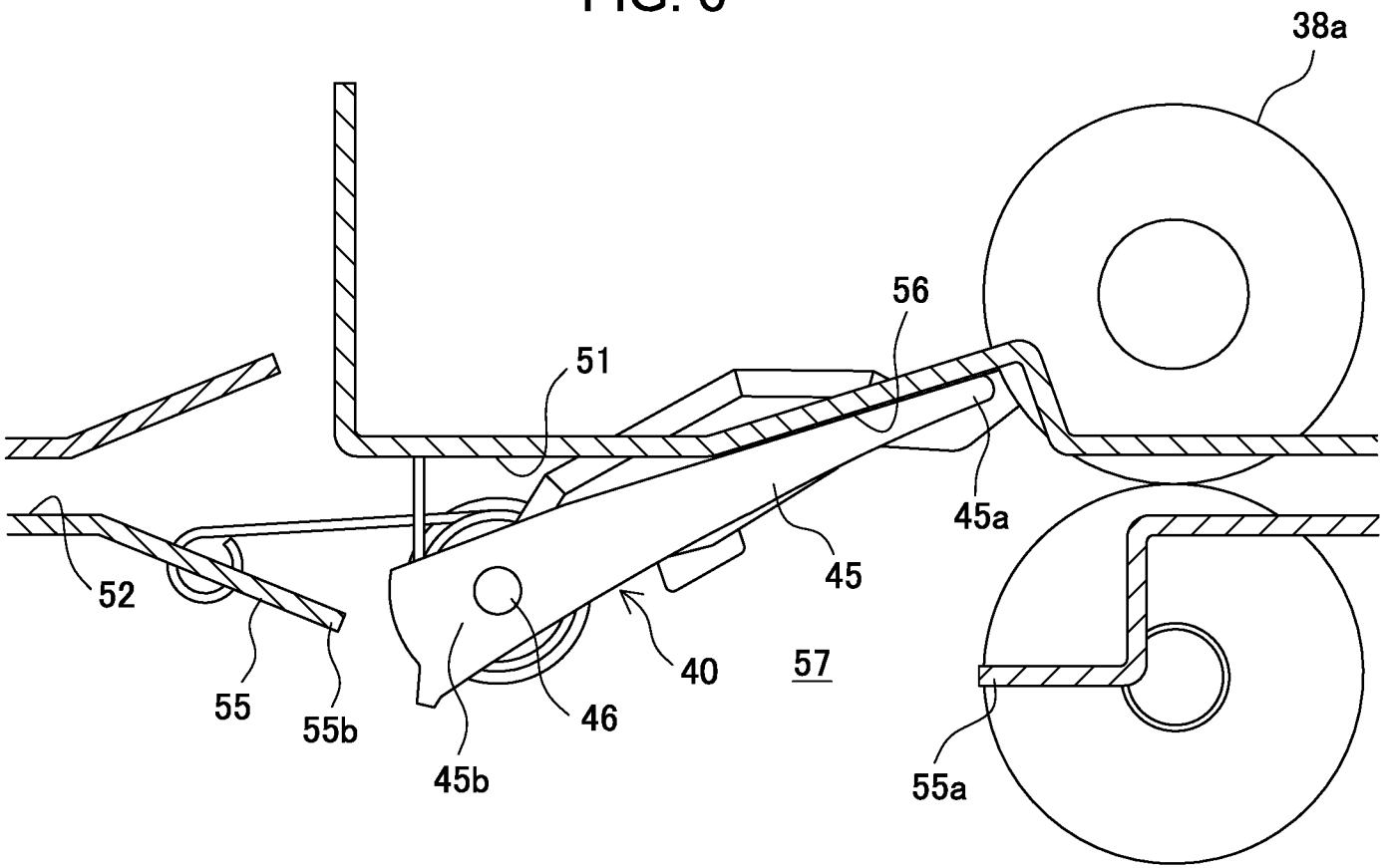
FIG. 6 is another partial enlarged view illustrating operation of the flap member.

As shown in FIGS. 5 and 6, the switch portion 40 is comprised of a flap member 45 disposed between an opening end portion 55*b* on the downstream side in the sheet conveyance direction for defining the opening portion 57 in the sheet conveyance direction and an opening end portion 55*a* on the upstream side, in the lower guide 55 of the common conveyance path 51. In the flap member 45, a base end portion 45*b* is coupled to a rotation shaft 46 in the sheet width direction, and is configured to rotate vertically a front end portion 45*a* on the upstream side in the sheet conveyance direction. The base end portion 45*b* of the flap member 45 is disposed near the opening end portion 55*b* of the lower guide 55, and the front end portion 45*a* is disposed to be capable of being placed on the opening end portion 55*a* of the lower guide 55.

FIG. 5 illustrates a first rotation position of the flap member 45 supported by the front end portion 45*a* of the flap member 45 coming into contact with on the opening end portion 55*a* of the lower guide 55. In this first rotation position, the flap member 45 closes the opening portion 57, and a top face of the flap member 45 is used as a sheet guide face for guiding the conveyed sheet, and forms a part of the common conveyance path 51. By this means, the sheet conveyed from the storage chamber 21 in the sheet conveyance direction smoothly passes through the common conveyance path 51, and is capable of being conveyed to the connection path 52.

FIG. 6 illustrates a second rotation position of the flap member 45 where the front end portion 45*a* of the flap member 45 comes into contact with an underside of an upper guide 56 of the common conveyance path 51. In the second rotation position, the flap member 45 interrupts the common conveyance path 51 to open the opening portion 57. At this point, the underside of the flap member 45 forms a sheet guide face, and the sheet conveyed from the storage chamber 21 in the sheet conveyance direction is thereby guided by the sheet guide face to pass through the opening portion 57 from the common conveyance path 51, and falls into the multi feed sheet storage section 42 to be stored.

Thus, in the common conveyance path 51, the switch portion 40 functions as a position changing member capable of changing the position to the first rotation position for guiding the sheet to the downstream side in the sheet conveyance direction, and to the second rotation position for opening the opening portion 57 to guide the sheet to the multi feed sheet storage section 42. Therefore, the switch portion 40 is provided with a drive mechanism for driving the rotation shaft 46 to rotate so that the flap member 45 is positioned in the first rotation position or the second rotation position. Further, the switch portion 40 is provided with a switch detecting sensor 43 for detecting whether the flap member 45 is positioned in the first rotation position or the second rotation position.

Figure 7:
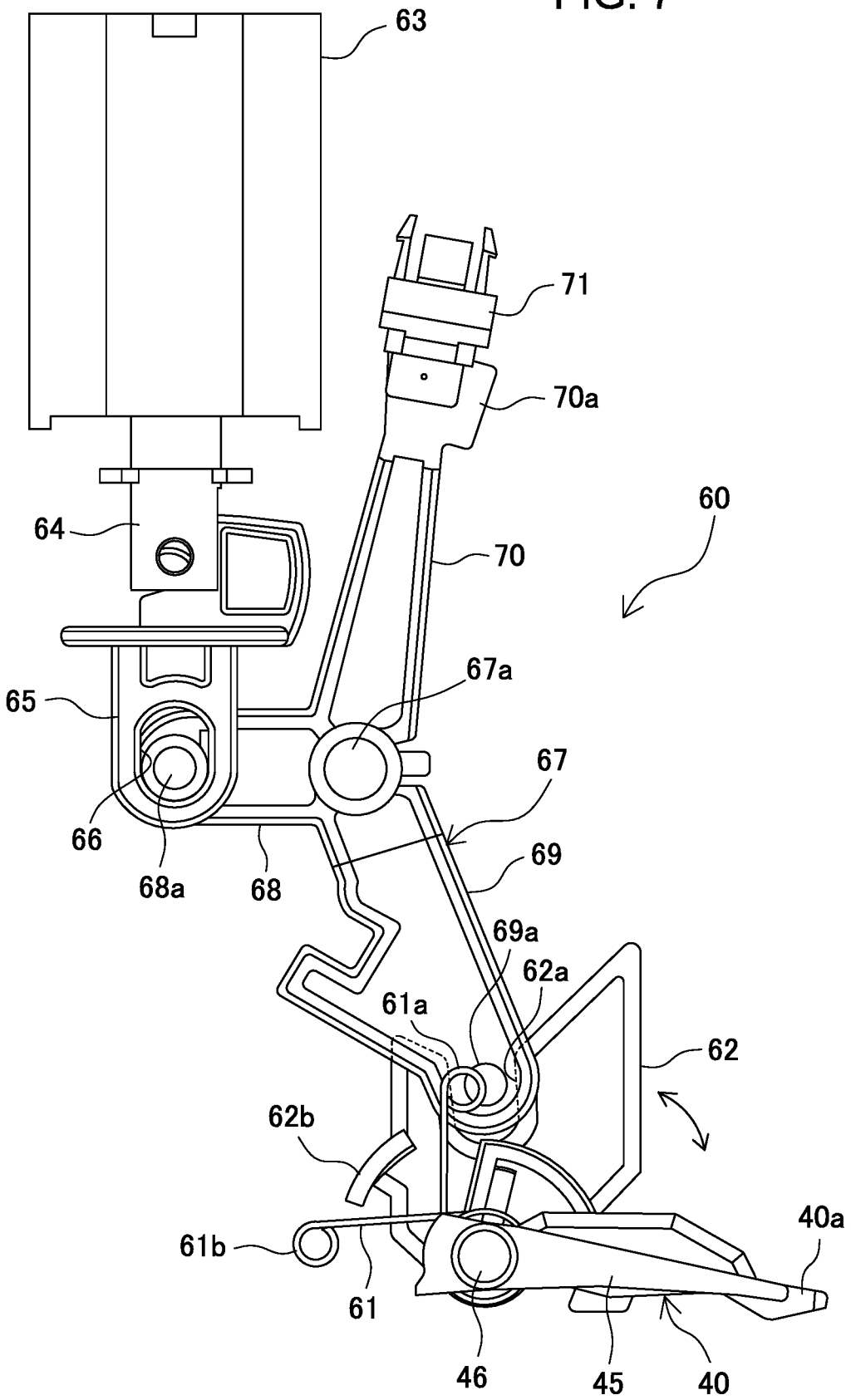
FIG. 7 is a partial enlarged view illustrating drive of the flap member.
Figure 8:
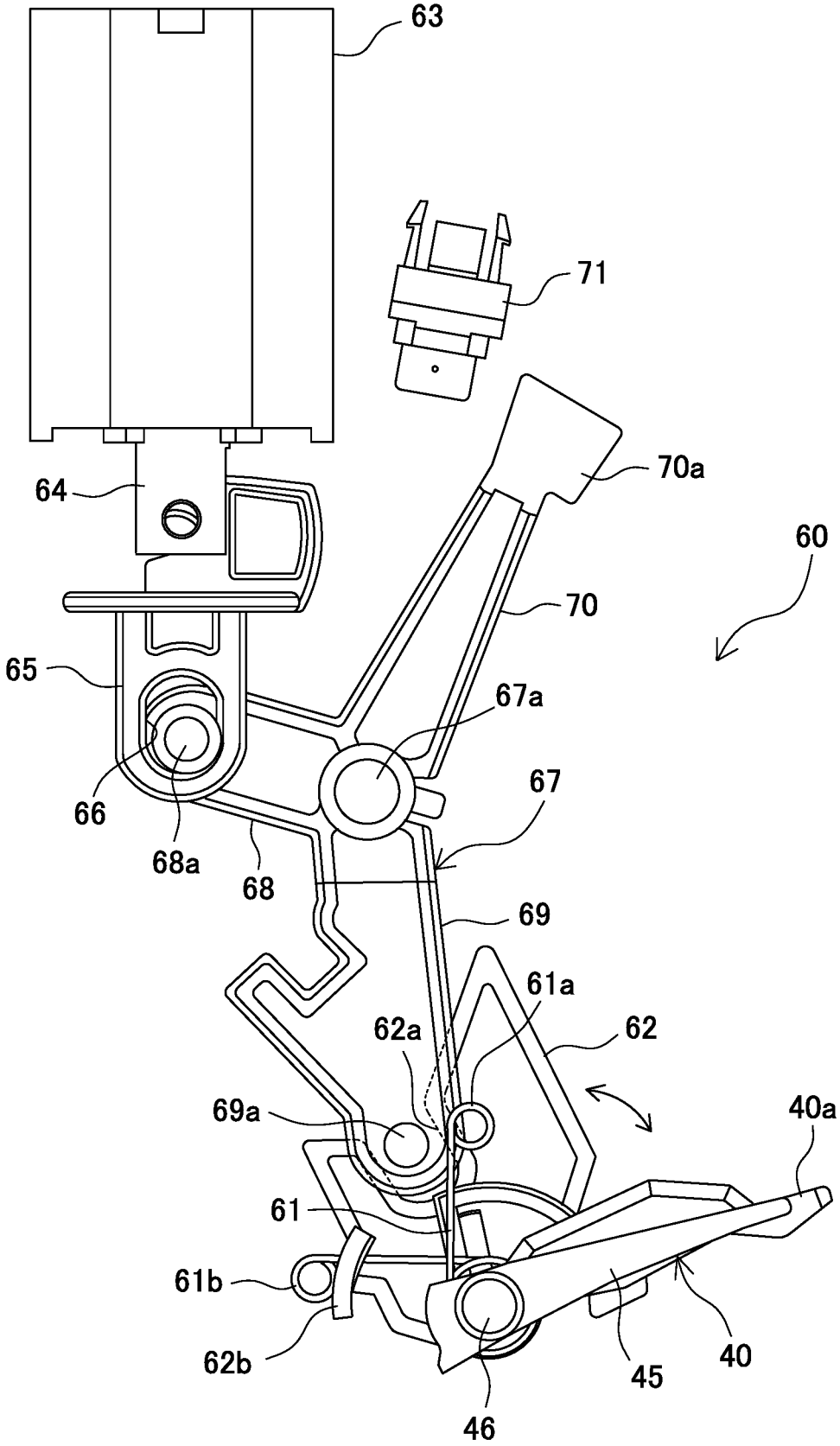
FIG. 8 is another partial enlarged view illustrating drive of the flap member.

For example, the drive mechanism is capable of adopting a solenoid type drive apparatus 60 shown in FIGS. 7 and 8. The solenoid type drive apparatus 60 has a biasing member comprised of a helical torsion coil spring 61 for biasing the flap member 45 to the first rotation position. In the helical torsion coil spring 61, the rotation shaft 46 is inserted into the coil spring portion. One end (back side in FIGS. 7 and 8) of the rotation shaft 46 is coupled to a drive arm member 62, and the member is able to rotate integrally in accordance with rotation of the rotation shaft 46.

The solenoid type drive apparatus 60 has a solenoid 63 as an actuator for driving and rotating the rotation shaft 46, and a coupling tool 65 is integrally coupled to a front end of a plunger 64 for performing forward/backward operation with respect to the solenoid 63. The drive arm member 62 and coupling tool 65 are coupled with a coupling arm member 67 disposed therebetween. The coupling arm member 67 is supported by a pivot 67*a* so as to rotate in a rotation plane the same as or parallel with the rotation plane of the flap member 45.

The coupling arm member 67 has three arms 68 to 70 extending from the pivot 67*a* in the radius direction inside the rotation plane. The arm 68 extends toward a front end of the coupling tool 65 coupled to a front end of the plunger 64, and a protruding shaft 68*a* provided in its front end is fitted into an engagement hole 66 provided to penetrate in the front end of the coupling tool 65. By this means, when the solenoid 63 is driven to cause the plunger 64 to perform forward/backward operation, the coupling arm member 67 rotates on the pivot 67*a* as the center.

The arm 69 of the coupling arm member 67 extends toward the drive arm member 62, and a protruding shaft 69*a* provided in its front end is fitted into a groove 62*a* provided to be concave in a side on the side opposed to the coupling arm member 67 of the drive arm member 62. By this means, when the coupling arm member 67 rotates on the pivot 67*a* as the center, the drive arm member 62 rotates about the rotation shaft 46 as the center, and by this means, the flap member 45 rotates.

The solenoid type drive apparatus 60 further has a detecting sensor 71 disposed on the same side as the coupling arm member 67 of the solenoid 63. The arm 70 of the coupling arm member 67 extends toward the detecting sensor 71, and is provided, at its front end, with a detection flag 70*a*. The detecting sensor 71 is comprised of a publicly known photo interrupter, and is disposed to be ON/OFF by a rotation position of the detection flag 70*a* corresponding to the first rotation position and the second rotation position of the flap member 45.

The helical torsion coil spring 61 has two terminal portions extending linearly from the coil spring portion in the radius direction. In order for the biasing force of the helical torsion coil spring 61 to act in a direction (counterclockwise direction in FIG. 8) for moving the flap member 45 from the first rotation position to the second rotation position, one of the terminal portions engages in a fixed portion (not shown) of the sheet feed apparatus 12, and the other one of the terminal portions is disposed to be able to engage in an engagement portion 62*b* of the drive arm member 62.

As shown in FIG. 7, in driving the solenoid 63 to move the plunger 64 forward, the coupling arm member 67 rotates in the counterclockwise direction in the figure to rotate the drive arm member 62 in the clockwise direction in the figure, and the other terminal portion of the helical torsion coil spring 61 is disengaged from the engagement portion 62*b* of the drive arm member 62. By this means, the drive arm member 62 is released from the biasing force of the helical torsion coil spring 61, and the flap member 45 is maintained in the first rotation position. As a result, as shown in FIG. 5, the common conveyance path 51 is maintained in an opened state for enabling the sheet to be conveyed to the connection path 52.

As shown in FIG. 8, in driving the solenoid 63 to move the plunger 64 backward, the coupling arm member 67 rotates in the clockwise direction in the figure to rotate the drive arm member 62 in the counterclockwise direction in the figure, and the other terminal portion of the helical torsion coil spring 61 engages in the engagement portion 62*b* of the drive arm member 62. By this means, the drive arm member 62 rotates further in the counterclockwise direction by the biasing force of the helical torsion coil spring 61, and the flap member 45 is rotated from the first rotation position to the second rotation position and is maintained. As a result, as shown in FIG. 6, the common conveyance path 51 is interrupted by the flap member 45, and is maintained in a state in which the opening portion 57 is opened to drop the sheet into the multi feed sheet storage section 42.

Operation when multi feed of sheets is detected will be described next. When the multi feed detecting sensor 41 of the conveyance path 22 detects multi feed of sheets, the sheet feed apparatus 12 conveys a sheet on the downstream side from multi-fed sheets in the sheet conveyance direction to the image forming apparatus 11, and halts conveyance operation of the multi-fed sheets and a sheet on the upstream side of the sheets in the sheet conveyance direction. When all sheets existing on the downstream side from the multi-fed sheets in the sheet conveyance direction are conveyed to the image forming apparatus 11, the sheet feed apparatus 12 completely halts sheet conveyance operation.

After the sheet conveyance operation is completely halted, the sheet feed apparatus 12 operates the switch portion 40 to open the opening portion 57 of the common conveyance path 51. When the flap member 45 rotates and shifts from the first rotation position to the second rotation position, the apparatus 12 operates the conveyance roller pair 36 of the conveyance path 22, and conveys the multi-fed sheets and a subsequent sheet halting inside the conveyance path 22 on the upstream side of the multi-fed sheets to the common conveyance path 51. By this means, the multi-fed sheets and subsequent sheet conveyed to the common conveyance path 51 are guided by the flap member 45 in the second rotation position, fall to the multi feed sheet storage section 42 from the opening portion 57 and are stored. The multi-fed sheets and subsequent sheet conveyed to the common conveyance path 51 are detected by the horizontal conveyance sensor 39*a*. After a lapse of a predetermined time since the multi feed detecting sensor 41 detects the multi feed of sheets and the horizontal conveyance sensor 39*a* detects a rear end in the sheet conveyance direction of the sheets finally stored in the multi feed storage section 42, the switch portion 40 operates to return the flap member 45 to the first rotation position from the second rotation position. For example, the predetermined time herein is preferably set at about 500 ms.

Further, in the above-mentioned Embodiment, detection of the rear end of the sheet in the sheet conveyance direction by the horizontal conveyance sensor 39*a* is used as reference, and the rear end detection of the sheet may be performed by a sensor positioned on the upstream side from the horizontal conveyance sensor 39*a* in the sheet conveyance direction, for example, the multi feed detecting sensor 41.

Furthermore, the switch portion 40 may operate to return the flap member 45 to the first rotation position from the second rotation position, based on a time taken for the sheet to be fed in the conveyance path from each storage chamber 21 to the multi feed storage section 42.

It is possible to determine whether or not the multi feed sheet storage section 42 is in a full-load state incapable of storing new multi-fed sheets, by switch operation of the flap member 45 rotating between the first rotation position and the second rotation position. For example, in the state shown in FIG. 4, since the number of sheets stored in the multi feed sheet storage section 42 is the maximum storage number or exceeds such a number, new multi-fed sheets do not fall from the common conveyance path 51 to the multi feed sheet storage section 42, and are in a state of blocking the opening portion 57. Therefore, even in causing the switch portion 40 to perform switch operation after conveying the new multi-fed sheets to the common conveyance path 51, the flap member 45 is not able to return to the first rotation position from the second rotation position. It is detected by the switch detecting sensor 43 that the flap member 45 does not return to the first rotation position. Further, in the present invention, also in the case where the number of sheets stored in the multi feed sheet storage section 42 does not reach the maximum storage number, the full-load state includes states where new multi-fed sheets are not stored due to the fact that sheets dropped in the multi feed sheet storage section 42 are stacked disorderly and/or another some reason.

When it is not detected that the flap member 45 is in the first rotation position by the switch detecting sensor 43 even in causing the switch portion 40 to perform switch operation, the sheet feed apparatus 12 determines that the multi feed sheet storage section 42 is in the full-load state. Subsequently, even when there are multi-fed sheets and subsequent sheet which are not conveyed to the common conveyance path 51 yet and remain in the conveyance path 22, the apparatus halts sheet conveyance to the common conveyance path 51. Further, the full-load state of the multi feed sheet storage section 42 is notified to the image forming apparatus 11 side, and the image forming apparatus 11 side notifies a user of a warning to remove sheets inside the multi feed sheet storage section 42.

Further, in the case where the flap member 45 does not return to the first rotation position even by causing the switch portion 40 to perform switch operation, for example, by the reason that multi-fed portions of multi-fed sheets are small, detecting timing of sheet multi feed by the multi feed detecting sensor 41 is delayed, the front end of the multi-fed sheets moves to the downstream side from the flap member 45, and it may occur that the front end is nipped between the upper guide and the front end of the flap member 45 and halts inside the common conveyance path 51. In this case, since it is not possible to collect the multi-fed sheets in the multi feed sheet storage section 42, the switch operation of the switch portion 40 is halted, and the image forming apparatus 11 side notifies a user of a warning to clear a jam of sheets.

By controlling the switch operation of the switch portion 40 as described above, it is possible to eliminate inconvenience that may occur by forcibly continuing the switch operation of the switch portion 40 even when the multi sheet feed storage section 42 is in the full-load state, for example, the risk that makes it difficult to remove jammed sheets from inside the sheet feed apparatus 12 or clear the jam. Further, by prompt notification to the user, it is possible to recover the sheet feed apparatus 12 to a normal sheet conveyance state sooner.

Further, as well as the time multi feed of sheets is detected, the above-mentioned switch operation of the switch portion 40 is similarly applicable to the time a sheet jam occurs in the image forming apparatus 11, or the time a jam occurs on the downstream side from the flap member 45 inside the sheet feed apparatus 12. By this means, it is possible to collect the sheet remaining in the conveyance path 22 inside the sheet feed apparatus 12, inside the multi feed sheet storage section 42. As a result, it is possible to decrease an operation amount of jam removal by the user, and operation efficiency is given advantage.

When the sheet feed apparatus 12 detects that the user removes sheets stored in the multi feed sheet storage section 42 and closes an open/close cover accessible to the multi feed sheet storage section 42, the apparatus 12 ascertains again the state of the switch detecting sensor 43. At this point, when it is ascertained that the flap member 45 returns to the first rotation position with a signal from the switch detecting sensor 43, the apparatus cancels the above-mentioned notification of the full-load state of the multi feed storage section 42 to the user.

In the sheet feed apparatus 12, a control section 203 controls each section. The control section 203 has a CPU (Central Processing Unit), ROM (Read Only Memory) and RAM (Random Access Memory). Further, the control section 203 is able to communicate with a control section 140 of the image forming apparatus 11, and by communicating with the control section 140, controls feed timing of a sheet and the like.

Figure 9:
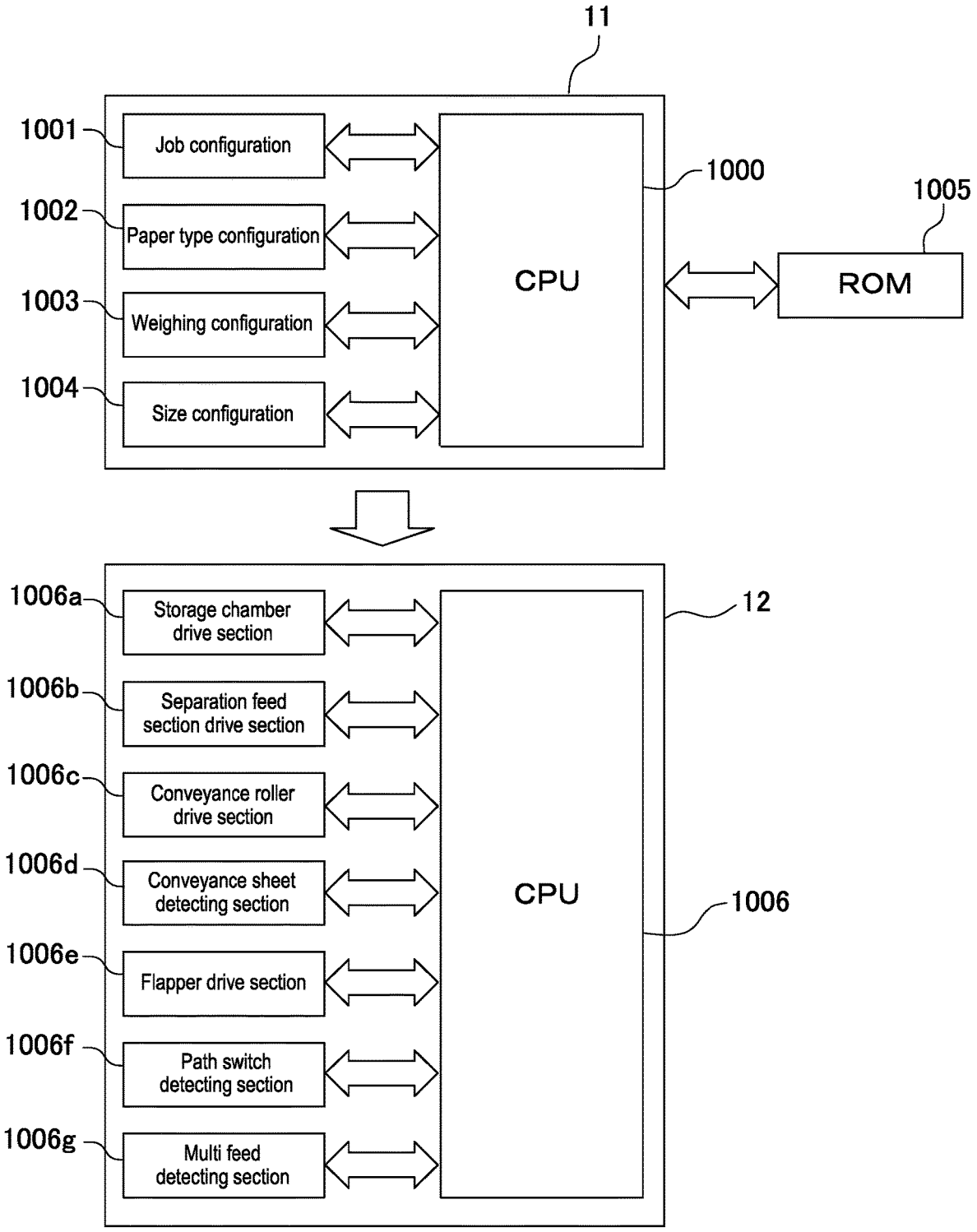
FIG. 9 is a block diagram to explain a control configuration of the sheet feed apparatus.

FIG. 9 illustrates a control configuration of the sheet feed apparatus 12. In the image forming system 10 where the image forming apparatus 11 and the sheet feed apparatus 12 are coupled as in this Embodiment, for example, a control CPU 1000 provided in the image forming apparatus 11 is provided with paper type configuration 1002, weighing configuration 1003, size configuration 1004 and job configuration 1001, and reads a processing execution program of the feed apparatus 12 from ROM 1005 to execute each processing.

The control section of the feed apparatus 12 is provided with the control CPU 1006. The control CPU 1006 receives a post-processing mode indication signal, jam signal, sheet size information, other information and command signal required for sheet feed processing from the control CPU 1000 of the image forming apparatus 11. The control CPU 1006 is provided with a storage chamber drive section 1006*a*, separation feed drive section 1006*b*, conveyance roller drive section 1006*c*, conveyance sheet detecting section 1006*d*, flapper drive section 1006*e*, path switch detecting section 1006*f* and multi feed detecting section 1006*g*.

Figure 10:
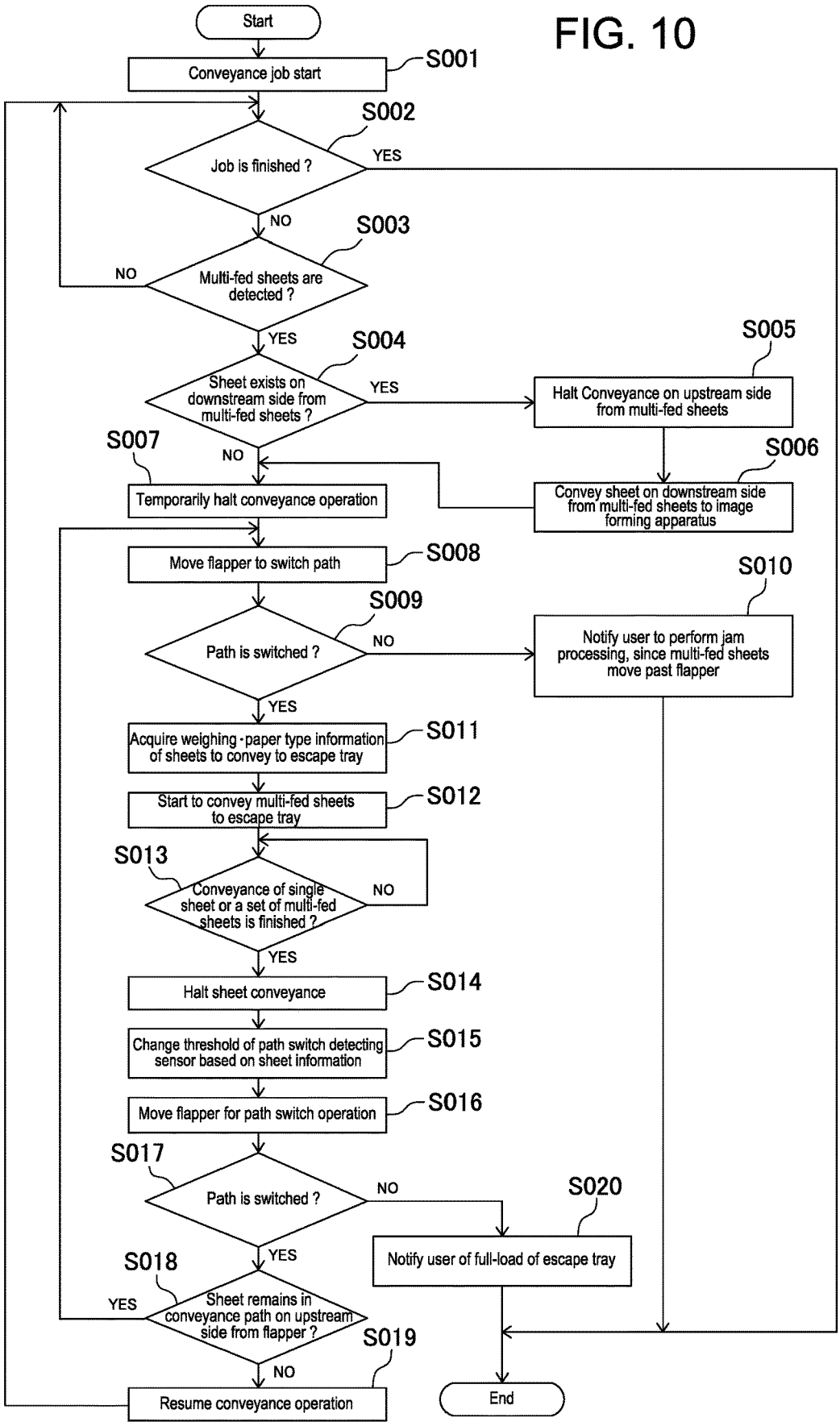
FIG. 10 is a flowchart to explain control processing by a CPU of the sheet feed apparatus.

Control processing by the CPU 1006 of the sheet feed apparatus 12 according to the Embodiment of FIG. 9 will be described next, using a flowchart of FIG. 10.

The control processing by the CPU 1006 is started by a user starting sheet feed operation. Further, the flowchart of the figure illustrates control when multi feed of sheets occurs. Accordingly, in the case where multi feed of sheets is not detected, by completion of a sheet feed job configured by the user, the control processing by the CPU 1006 is finished (S001, S002).

During execution of the sheet feed job configured by the user, the CPU determines whether or not multi feed of sheets is detected with a signal from the multi feed detecting sensor 41 of the conveyance path 22 (S003).

When multi feed of sheets is detected in step S003, the CPU determines whether or not a sheet exists on the downstream side from the multi-fed sheets, by the conveyance sensor 37 of the conveyance path 22 and the horizontal conveyance sensors 39*a*, 39*b* of the common conveyance path 51 (S004). In the case where the sheet exists on the downstream side from the multi-fed sheets, the CPU halts conveyance of the multi-fed sheets and a subsequent sheet existing on the upstream side from the sheets, and conveys the sheet existing on the downstream side from the multi-fed sheets to the image forming apparatus 11 (S005). When conveyance to the image forming apparatus 11 is finished, the CPU completely halts the sheet conveyance operation of the feed apparatus 12 (S006).

In the case where any sheet does not exist on the downstream side from the multi-fed sheets in step S003, the CPU halts all conveyance operation of the sheet feed apparatus 12 (S007).

Next, the CPU causes the switch portion 40 to perform the switch operation, shifts the flap member 45 to the second rotation position, and opens the opening portion 57 so that the sheet is able to fall in the multi feed sheet storage section 42 from the common conveyance path 51 (S008).

Next, by the switch detecting sensor 43, the CPU detects whether or not the flap member 45 shifts to the second rotation position (S009). At this point, in the case where the switch detecting sensor 43 does not detect that the flap member 45 shifts to the second rotation position, the CPU determines that the front end of the multi-fed sheets is conveyed to the downstream side from the flap member 45, halts the switch operation of the switch portion 40 to open the opening portion 57, and notifies the user to perform jam processing (S010).

When the switch detecting sensor 43 detects that the flap member 45 shifts to the second rotation position, the control CPU 1000 transmits information on the multi-fed sheets input from a control panel of the image forming apparatus 11 by the user to the control CPU 1006 of the sheet feed apparatus 12 to recognize (S011).

Next, the CPU 1006 starts conveyance of the multi-fed sheets to the multi feed sheet storage section 42 (S012). The CPU ascertains a detection state of the horizontal conveyance sensor 39*a*, and based on the fact that the rear end in the sheet conveyance direction of the finally conveyed sheet is detected, certain or more time elapses, and that a sheet succeeding to the sheet is not detected, determines whether or not the multi-fed sheets are conveyed to the multi feed sheet storage section 42 (S013). When the sheets are conveyed, the CPU halts conveyance operation to the multi feed sheet storage section 42 (S014).

Based on the sheet information recognized in step S011, the CPU sets a threshold of the switch detecting sensor 43 (S015).

After setting the threshold of the switch detecting sensor 43 in step S015, the CPU causes the switch portion 40 to perform the switch operation, returns the flap member 45 to the first rotation position, and makes the common conveyance path 51 a sheet conveyance-capable state (S016).

At this point, in the case where the switch detecting sensor 43 does not detect the flap member 45 even when the switch portion 40 performs the switch operation (S017), the CPU determines that the multi feed sheet storage section 42 is in the full-load state, and notifies the user of processing of sheets in the multi feed sheet storage section 42 (S020).

In the case where the switch detecting sensor 43 detects the flap member 45 in step S017, the CPU detects whether or not a sheet under conveyance exists on the upstream side from the multi-fed sheets by the conveyance sensor 37, and when detecting existence of the sheet, returns to step S008 (S018).

When the CPU does not detect existence of the sheet under conveyance on the upstream side from the multi-fed sheets, the CPU resumes the sheet conveyance operation and proceeds to step S002 (S019).

As described above, according to the sheet feed apparatus 12 of this Embodiment, it is possible to prevent inconvenience that jam removal is made difficult subsequently as a result that a sheet is forcibly conveyed by continuing the switch operation for discharging multi-fed sheets even when the multi feed sheet storage section 42 is in the full-load state, and it is also possible to promptly detect a state in which multi feed of sheets is not automatically canceled to notify a user.

In addition, this application claims priority from Japanese Patent Application No. 2020-181448 and Japanese Patent Application No. 2021-158617 incorporated herein by reference.

The invention claimed is:

1. A sheet conveying apparatus comprising:

a conveying section adapted to convey a sheet in a predetermined conveyance direction;

a conveyance path adapted to guide the sheet conveyed by the conveying section;

a multi feed detecting section adapted to detect multi feed of sheets conveyed in the conveyance path;

a storage section disposed below the conveyance path to store multi-fed sheets with the multi feed detected by the multi feed detecting section;

a position changing member disposed between the conveyance path and the storage section to be able to change a position to a first position for guiding the sheet conveyed in the conveyance path to a downstream side in the conveyance direction in the position for closing an entry of the sheet from the conveyance path to the storage section, and to a second position for guiding the multi-fed sheets from the conveyance path to the storage section in the position for allowing the entry of the sheets from the conveyance path to the storage section;

a control section adapted to control operation of the position changing member for changing the position between the first position and the second position;

a detecting section adapted to detect whether the position changing member is positioned in the first position or the second position; and a determining section adapted to determine that the storage section is full-load, when the detecting section detects that the position changing member does not return to the first position, after the multi feed detecting section detects the multi feed of sheets, the control section changes the position of the position changing member to the second position from the first position, the multi-fed sheets are conveyed from the conveyance path to the storage section, and after a lapse of a predetermined time, the control section changes the position changing member toward the first position.

2. A sheet conveying apparatus comprising:

a conveying section adapted to convey a sheet in a predetermined conveyance direction;

a conveyance path adapted to guide the sheet conveyed by the conveying section;

a multi feed detecting section adapted to detect multi feed of sheets conveyed in the conveyance path;

a storage section disposed below the conveyance path to store multi-fed sheets with the multi feed detected by the multi feed detecting section and a subsequent sheet conveyed in the conveyance path subsequently to the multi-fed sheets;

a position changing member disposed between the conveyance path and the storage section to be able to change a position to a first position for guiding the sheet conveyed in the conveyance path to a downstream side in the conveyance direction in the position for closing an entry of the sheet from the conveyance path to the storage section, and to a second position for guiding the multi-fed sheets and the subsequent sheet from the conveyance path to the storage section in the position for allowing the entry of the sheets from the conveyance path to the storage section;

a control section adapted to control operation of the position changing member for changing the position between the first position and the second position;

a detecting section adapted to detect whether the position changing member is positioned in the first position or the second position; and a determining section adapted to determine that the storage section is full-load, when the detecting section detects that the position changing member does not return to the first position, after the multi feed detecting section detects the multi feed of sheets, the control section changes the position of the position changing member to the second position from the first position, the multi-fed sheets and the subsequent sheet subsequently to the multi-fed sheets are conveyed to the storage section, and after a lapse of a predetermined time, the control section changes the position changing member toward the first position.

3. The sheet conveying apparatus according to claim 1, wherein the position changing member is provided with a flap member rotating between a first rotation position corresponding to the first position and a second rotation position corresponding to the second position, the flap member supports a sheet on the conveyance path to be able to convey to the downstream side in the conveyance direction in the first rotation position, and guides a sheet on the conveyance path to the storage section in the second rotation position, and the determining section determines that the storage section is full-load, when the detecting section detects that the flap member does not return to the first rotation position, after the flap member rotates from the first rotation position to the second rotation position, and the sheet on the conveyance path is stored in the storage section.

4. The sheet conveying apparatus according to claim 1, further comprising:

a detecting sensor adapted to detect that the storage section is full-load.

5. The sheet conveying apparatus according to claim 1, further comprising:

a count section adapted to count the number of sheets stored in the storage section.

* * * * *